US009207005B2

(12) United States Patent
Dugast et al.

(10) Patent No.: US 9,207,005 B2
(45) Date of Patent: Dec. 8, 2015

(54) DEVICE FOR SEPARATING LUBRICANT FROM A LUBRICANT-REFRIGERATING GAS MIXTURE DISCHARGED FROM AT LEAST ONE REFRIGERANT COMPRESSOR

(75) Inventors: Philippe Dugast, Saint Bernard (FR); Patrice Bonnefoi, Saint Didier au Mont d'or (FR); Jean De Bernardi, Lyons (FR); Philippe Dewitte, Saint Cyr au Mont d'or (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 1036 days.

(21) Appl. No.: 13/144,008

(22) PCT Filed: Feb. 22, 2010

(86) PCT No.: PCT/FR2010/050297

§ 371 (c)(1),
(2), (4) Date: Aug. 16, 2011

(87) PCT Pub. No.: WO2010/097537

PCT Pub. Date: Sep. 2, 2010

(65) Prior Publication Data

US 2012/0011872 A1 Jan. 19, 2012

(30) Foreign Application Priority Data

Feb. 27, 2009 (FR) ..... 09 51240

(51) Int. Cl.
*F25B 43/02* (2006.01)
*F25B 31/00* (2006.01)

(52) U.S. Cl.
CPC ..... *F25B 43/02* (2013.01); *F25B 31/004* (2013.01); *F25B 2400/02* (2013.01); (Continued)

(58) Field of Classification Search
CPC .... F25B 43/02; F25B 31/004; F25B 2400/02; F25B 2700/1931; F25B 2700/1933; F25B 2700/2105; F25B 2700/21155
USPC ..... 62/470, 238.6, 472, 473, 503, 192, 193, 62/84; 96/420
See application file for complete search history.

(56) References Cited

U.S. PATENT DOCUMENTS 1,732,039 A 10/1929 Cuthbert
3,825,372 A * 7/1974 Lundberg et al. ..... 417/321
(Continued)

FOREIGN PATENT DOCUMENTS

EP 2 020 578 A2 2/2009
FR 2 885 966 A1 11/2006
(Continued)

OTHER PUBLICATIONS

Jun. 29, 2010 International Search Report issued in International Application No. PCT/FR2010/050297.

*Primary Examiner* — Joseph Trpisovsky
(74) *Attorney, Agent, or Firm* — Oliff PLC

(57) ABSTRACT

The separating device according to the invention comprises a body delimiting a separating chamber, at least one inlet orifice emerging in the separating chamber and intended to be connected to a discharge orifice of the refrigerant compressor so as to allow a lubricant-refrigerating gas mixture to be introduced into the separating chamber, at least one lubricant outlet orifice emerging in the separating chamber and intended to be connected to a lubricant pan formed in the refrigerant compressor. The separating device comprises a first measuring means arranged to measure the temperature of the lubricant contained in the lubricant pan formed in the refrigerant compressor, and a regulating means arranged to regulate the temperature of the lubricant separated in the separating chamber as a function of the temperature of the lubricant measured by said first measuring means.

15 Claims, 5 Drawing Sheets

(52) U.S. Cl.
CPC *F25B 2700/1931* (2013.01); *F25B 2700/1933* (2013.01); *F25B 2700/2105* (2013.01); *F25B 2700/21155* (2013.01)

(56) References Cited

U.S. PATENT DOCUMENTS

| | | | | | |
|---|---|---|---|---|---|
| 4,336,001 | A | | 6/1982 | Andrew et al. | |
| 5,016,447 | A | * | 5/1991 | Lane et al. | 62/470 |
| 5,042,271 | A | | 8/1991 | Manz | |
| 5,099,976 | A | | 3/1992 | Jamison | |
| 5,170,640 | A | * | 12/1992 | Heitmann et al. | 62/470 |
| 5,347,821 | A | * | 9/1994 | Oltman et al. | 62/84 |
| 5,487,769 | A | | 1/1996 | Hutchinson et al. | |
| 5,590,539 | A | * | 1/1997 | Marohl et al. | 62/84 |
| 6,497,114 | B1 | | 12/2002 | Strikis et al. | |
| 6,871,511 | B2 | | 3/2005 | Okaza et al. | |
| 8,424,337 | B2 | * | 4/2013 | Scarcella et al. | 62/470 |
| 2002/0023459 | A1 | * | 2/2002 | Kiyokawa et al. | 62/469 |
| 2005/0100449 | A1 | * | 5/2005 | Hahn et al. | 417/279 |
| 2006/0213219 | A1 | * | 9/2006 | Beving et al. | 62/468 |
| 2007/0140870 | A1 | * | 6/2007 | Fukanuma et al. | 417/269 |

FOREIGN PATENT DOCUMENTS

| | | |
|---|---|---|
| JP | A-04-177059 | 6/1992 |
| JP | A-06-002961 | 1/1994 |
| JP | A-06-074579 | 3/1994 |
| JP | A-2000-346502 | 12/2000 |
| WO | WO 2005/012811 A1 | 2/2005 |

* cited by examiner

DEVICE FOR SEPARATING LUBRICANT FROM A LUBRICANT-REFRIGERATING GAS MIXTURE DISCHARGED FROM AT LEAST ONE REFRIGERANT COMPRESSOR

The present invention relates to a device for separating lubricant from a lubricant-refrigerating gas mixture discharged from at least one refrigerant compressor, and a refrigeration system including such a device.

Document FR 2 885 966 describes a Scroll compressor, comprising a sealed enclosure delimited by a shroud, delimiting a suction space and a compression space respectively arranged on either side of a body contained in the enclosure. The shroud delimiting the sealed enclosure comprises a refrigerating gas inlet.

An electric motor is arranged in the sealed enclosure, with a stator situated on the outer side, mounted stationary relative to the shroud, and a rotor arranged in the central position, secured to a drive shaft, in the form of a crankshaft, whereof a first end drives an oil pump supplying, from oil contained in a pan situated in the lower part of the enclosure, a lubrication pipe formed in the central part of the shaft. The lubrication pipe has lubrication orifices at different guide bearings of the drive shaft.

The compression volume contains a compression stage comprising a stationary volute equipped with a scroll engaged in a scroll of a mobile volute, the two scrolls delimiting at least one variable volume compression chamber. The second end of the drive shaft is equipped with an eccentric driving the mobile volute following an orbital movement, to compress the suctioned refrigerating gas.

From a practical perspective, refrigerating gas arrives from the outside and penetrates the sealed enclosure. Part of the gas is directly suctioned towards the compression space, while the other part of the gas passes through the motor before flowing towards the compression stage. All of the gas arriving either directly at the compression stage, or after passage through the motor, is suctioned by the compression stage, penetrating at least one compression chamber delimited by the two scrolls, the inlet being made on the periphery of the compression stage, and the gas being conveyed towards the center of the scrolls as the compression occurs through a decrease in the volume of the compression chambers, resulting from the movement of the mobile volute relative to the stationary volute. The compressed gas exits in the central part of the compressed gas recovery chamber.

Depending on the internal flow configurations of this type of compressor, the refrigerating gas entering the compressor can become charged with oil, this oil for example being able to come from leaks in the bearings, the gas sweeping over the surface of the oil pan.

It must be noted that the oil level in the refrigerating gas evolves as a function of the speed of rotation of the rotor of the electric motor and the operating conditions of the compressor (suction pressure and temperature, discharge pressure).

Thus, at a high speed of rotation of the rotor or at certain operating points (high suction density, low compression rate), the level of oil in the refrigerating gas leaving the compressor can become excessive. The direct consequence of this excessive level of oil in the gas is a loss of efficiency of the heat exchange of the exchangers situated downstream or upstream of the compressor, given the fact that the oil droplets contained in the gas tend to deposit on the walls of the exchangers and form a layer of insulating oil on the latter.

Moreover, an excessive level of oil in the gas can also cause emptying of the oil pan, which could lead to poor lubrication of the guide bearings of the drive shaft, and therefore the destruction of the compressor.

Document U.S. Pat. No. 6,871,511 describes one solution for offsetting these drawbacks. This solution consists of connecting an oil separating device to a discharge orifice of the compressor.

The separating device described in document U.S. Pat. No. 6,871,511 in particular comprises a body delimiting a separation chamber for separating oil from an oil-refrigerating gas mixture discharged from the refrigerant compressor, an inlet orifice of a lubricant-refrigerating gas mixture emerging in the separating chamber and intended to be connected to the discharge orifice of the refrigerant compressor, and an oil outlet orifice emerging in the separation chamber and intended to be connected to an oil pan formed in the refrigerant compressor.

As a result, such a separating device makes it possible to ensure a return, towards the oil pan of the compressor, of the oil discharged with the refrigerating gas outside the compressor, and therefore to prevent emptying of the oil pan and an excessive deposition of oil on the exchangers.

Document U.S. Pat. No. 6,871,511 describes the use of carbon dioxide as refrigerating gas.

The use of such a refrigerating gas has the advantage of preserving the environment and the ozone layer.

The use of carbon dioxide as refrigerating gas does, however, have the drawback of leading to very high discharge pressures compared to the use of hydrofluorocarbon or hydrochlorofluorocarbon as refrigerating gas.

Such discharge pressures create substantial forces at the guide bearings of the drive shaft and therefore require the use of a very good quality oil, i.e. having a high viscosity, in order to lubricate these guide bearings.

It must be noted that carbon dioxide is very soluble in oil when the latter has a temperature close to the saturation temperature of carbon dioxide. As a result, if the temperature of the oil is close to the saturation temperature of the carbon dioxide, the carbon dioxide dissolves in the oil and the viscosity of the mixture drops.

This therefore results in poor lubrication of the guide bearings of the drive shaft when the temperature of the oil is too low.

It must also be noted that the viscosity of the oil drops naturally when its temperature increases.

This therefore results in poor lubrication of the guide bearings of the drive shaft when the temperature of the oil is too high.

The present invention aims to resolve these drawbacks.

The technical problem at the base of the invention therefore consists of providing a device for separating lubricant that has a simple and economical structure, while ensuring satisfactory lubrication of the guide bearings of the drive shaft.

To that end, the invention relates to a device for separating lubricant from a lubricant-refrigerating gas mixture discharged from at least one refrigerant compressor, the separating device comprising a body delimiting a separating chamber, at least one inlet orifice emerging in the separating chamber and intended to be connected to a discharge orifice of the refrigerant compressor so as to allow a lubricant-refrigerating gas mixture to be introduced into the separating chamber, at least one lubricant outlet orifice emerging in the separating chamber and intended to be connected to a lubricant pan formed in the refrigerant compressor, characterized in that the separating device comprises a first measuring means arranged to measure the temperature of the lubricant contained in the lubricant pan formed in the refrigerant compressor, and regulating means arranged to regulate the temperature of the lubricant separated in the separating chamber as a function of the temperature of the lubricant measured by said first measuring means.

Thus, the separating device according to the invention makes it possible to regulate the temperature of the lubricant separated from the lubricant-refrigerating gas mixture and intended to be returned into the compressor at a predetermined value. These provisions make it possible to control the temperature of the lubricant contained in the lubricant pan of the compressor, and therefore to keep the viscosity of the lubricant at a value ensuring satisfactory lubrication of the guide bearings of the drive shaft, even when the refrigerating gas is carbon dioxide.

Advantageously, the separating device comprises a second measuring means arranged to measure the temperature of the lubricant separated in the separating chamber, and the regulating means is arranged to regulate the temperature of the separated lubricant to at least one predetermined value or in a predetermined range of values as a function of the temperatures measured by said first and second measuring means.

According to one embodiment of the invention, the predetermined value at which the regulating means regulates the temperature of the separated lubricant is not a fixed value, but is a value that varies as a function of the suction and/or discharge pressure of the compressor to which the separating device is connected.

Advantageously, the separating device has a refrigerating gas discharge orifice emerging in the separating chamber, and a check device able to move between a position covering the discharge orifice and a position freeing the discharge orifice. These provisions make it possible to avoid a migration of the refrigerating gas towards the compressor when the installation on which the separating device is mounted is stopped, and therefore a potential condensation of the refrigerating gas on the guide bearings that could cause degreasing of the latter when the refrigerating gas is carbon dioxide. Thus, the presence of the check valve makes it possible to avoid so-called "dry" start-ups of the compressor. It must be noted that the migration of the refrigerating gas towards the compressor can for example be due to heating of the condenser by the sun.

Preferably, the separating device has a poppet valve, mounted on the body, able to move between an open position in which the separating chamber is put in communication with the atmosphere and a closed position, the poppet valve being moved into its open position when the pressure reigning in the separating chamber exceeds a predetermined value. Such an arrangement of the poppet valve is more particularly used when the refrigerating gas is carbon dioxide.

According to one alternative embodiment, when the poppet valve is in its open position, the separating chamber is put in communication with the low-pressure part of the compressor. Such an arrangement of the valve is preferred when the refrigerating gas is for example a hydrofluorocarbon or a hydrochlorofluorocarbon.

According to one embodiment of the invention, the separating device comprises several inlet orifices emerging in the separating chamber, the inlet orifices each being intended to be connected to the discharge orifice of a different refrigerant compressor or a different compression unit of a same compressor. Thus, under in-use conditions, the separating device forms a discharge manifold connected to the different compressors of the installation or different compression units of a same compressor. These provisions allow the separating device to damp the pressure pulses coming from the different compressors, therefore to improve the output and reliability and to reduce the noise of the installation on which the separating device is mounted.

According to one embodiment of the invention, the regulating means is arranged to regulate the temperature of the separated lubricant at a first predetermined value and a second predetermined value, the first predetermined value being greater than the second predetermined value, and the regulating means has a selection means arranged to select, among the first and second predetermined values, the value at which the temperature of the separated lubricant must be regulated.

These provisions make it possible to adapt the value at which the temperature of the separated lubricant is regulated as a function of the installation on which the separating device is mounted. In this way, when the separating device is mounted on a heating installation, the selection means is actuated so as to select the first predetermined value, and when the separating device is mounted on a refrigerating installation, the selection means is actuated so as to select the second predetermined value. This results in the possibility of optimizing the performance of the installation on which the separating device is mounted.

Advantageously, the regulating means has at least one cooling device arranged to cool the separated lubricant and/or at least one heating device arranged to heat the separated lubricant.

According to one embodiment of the invention, the cooling device is a heat exchanger traveled through by the water of a hot domestic supply water circuit. These provisions make it possible to recover calories from the lubricant so as to heat the hot domestic supply water circuit.

Preferably, the cooling device has a fan and/or a gilled radiator as cooling devices.

Preferably, the regulating means has a control means arranged to control the operation of the cooling device and/or the heating device as a function of the temperature of the lubricant measured by the first and/or second measuring means.

Advantageously, the regulating means has a fan, and the control means is arranged to control the operation of the fan as a function of the temperature of the lubricant measured by the first and/or second measuring means. The control means is preferably arranged to control the powering on and stopping of the fan as a function of the lubricant temperature measured by the first and/or second measuring means. Preferably, the control means is also arranged to control the rotational speed of the fan as a function of the lubricant temperature measured by the first and/or second measuring means.

According to one embodiment of the invention, the first and/or second measuring means has a temperature sensor.

Advantageously, the separating device is a cyclone separating device.

The present invention also relates to a heating and/or refrigerating system having at least one refrigerant compressor comprising a discharge orifice of a lubricant-refrigerating gas mixture, characterized in that it has a separating device according to the invention, the inlet orifice of the separating device being connected to the discharge orifice of the refrigerant compressor. Preferably, the refrigerant compressor is a piston or scroll refrigerant compressor. Advantageously, the lubricant is substantially at the suction pressure or a higher pressure.

Advantageously, the heating and/or refrigeration system comprises several refrigerant compressors, and the discharge orifice of each refrigerant compressor is connected to an inlet orifice of the separating device.

The invention will be well understood using the following description in reference to the appended diagrammatic drawing showing, as non-limiting examples, two embodiments of this separating device.

FIGS. 1 to 3 show a separating device 2 for separating an oil-refrigerating gas mixture discharged from a refrigerant compressor.

Figure 1:
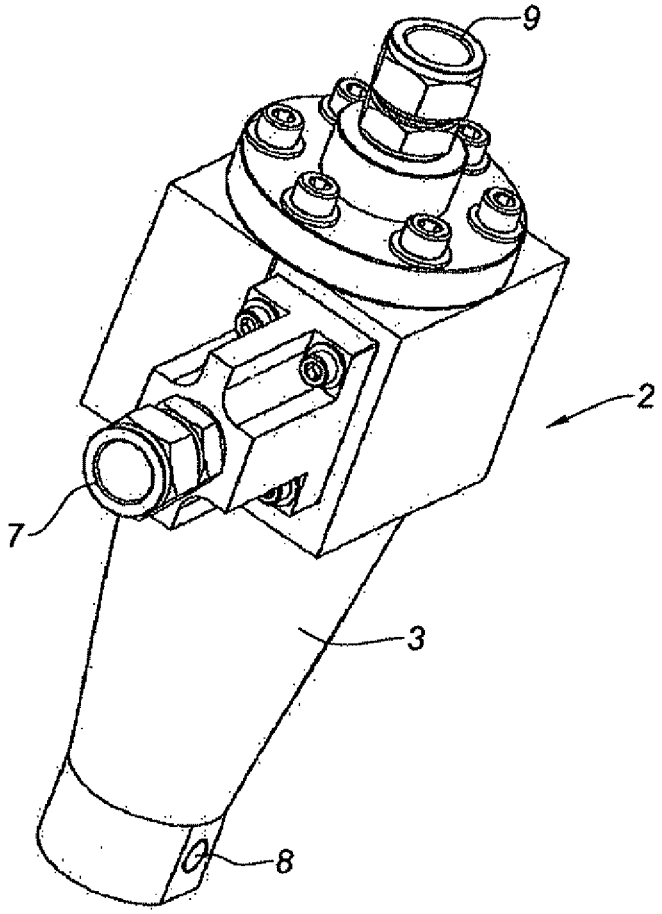
FIG. 1 is a perspective view of a separating device according to a first embodiment of the invention.

The separating device 2 comprises a body 3 delimiting a separating chamber 4. The separating chamber 4 has a cylindrical upper portion 5 extended by a tapered lower portion 6 converging opposite the upper portion 5. The separating device 2 thus constitutes a cyclone separating device.

The separating device 2 also comprises an inlet orifice 7 emerging tangentially in the separating chamber 4. The inlet orifice 7 is intended to be connected to a discharge orifice of the refrigerant compressor so as to allow a lubricant-refrigerating gas mixture to be introduced into the separating chamber.

The separating device 2 comprises a lower oil outlet orifice 8 emerging in the lower end of the separating chamber 4.

The separating device 2 has an upper refrigerating gas discharge orifice 9 emerging axially in the separating chamber 4. The upper refrigerating gas discharge orifice 9 is intended to be connected to a condenser (or gas cooler).

The separating device 2 also comprises a temperature sensor 11 arranged to measure the temperature of the oil separated in the separating chamber 4. The temperature sensor 11 is arranged in the lower part of the body 3.

The separating device 2 also comprises a temperature sensor 10 arranged to measure the temperature of the lubricant contained in the lubricant pan formed in the refrigerant compressor.

The separating device 2 also comprises a regulating means 12 arranged to regulate the temperature of the oil separated in the separating chamber 4 at a first predetermined value as a function of the temperatures measured by the temperature sensors 10, 11. The predetermined value is preferably between 25 and 60° C.

The regulating means has a fan 13 on the one hand mounted on the lower part of the body 3 of the separating device 2, and on the other hand a control means 14 arranged to control the operation of the fan 13, i.e. the powering on and stopping of the fan and the rotational speed thereof, as a function of the oil temperatures measured by the temperature sensors 10, 11.

The separating device 2 advantageously has a check device 15, mounted on the body 3, able to move between a position covering the discharge orifice 9 and a position freeing the discharge orifice 9.

The regulating means 12 also has a heat exchanger 16 intended to be passed through by the oil separated in the separating chamber 4, the heat exchanger 16 comprising a first end 17 connected to the lubricant outlet orifice 8 and a second end 18 intended to be connected to the lubricant pan formed in the refrigerant compressor.

The separating device also has a poppet valve 19 mounted on the body 3 and comprising a check valve 20 able to move between an open position in which the separating chamber 4 is put in communication with the atmosphere and a closed position (shown in FIG. 2) in which the separating chamber 4 is isolated from the atmosphere, the check valve being moved into its open position when the pressure reigning in the separating chamber 4 exceeds a predetermined value. Preferably, the check valve is formed by a bead kept bearing under the action of a spring 21 against an orifice formed in the body 3.

Figure 4:
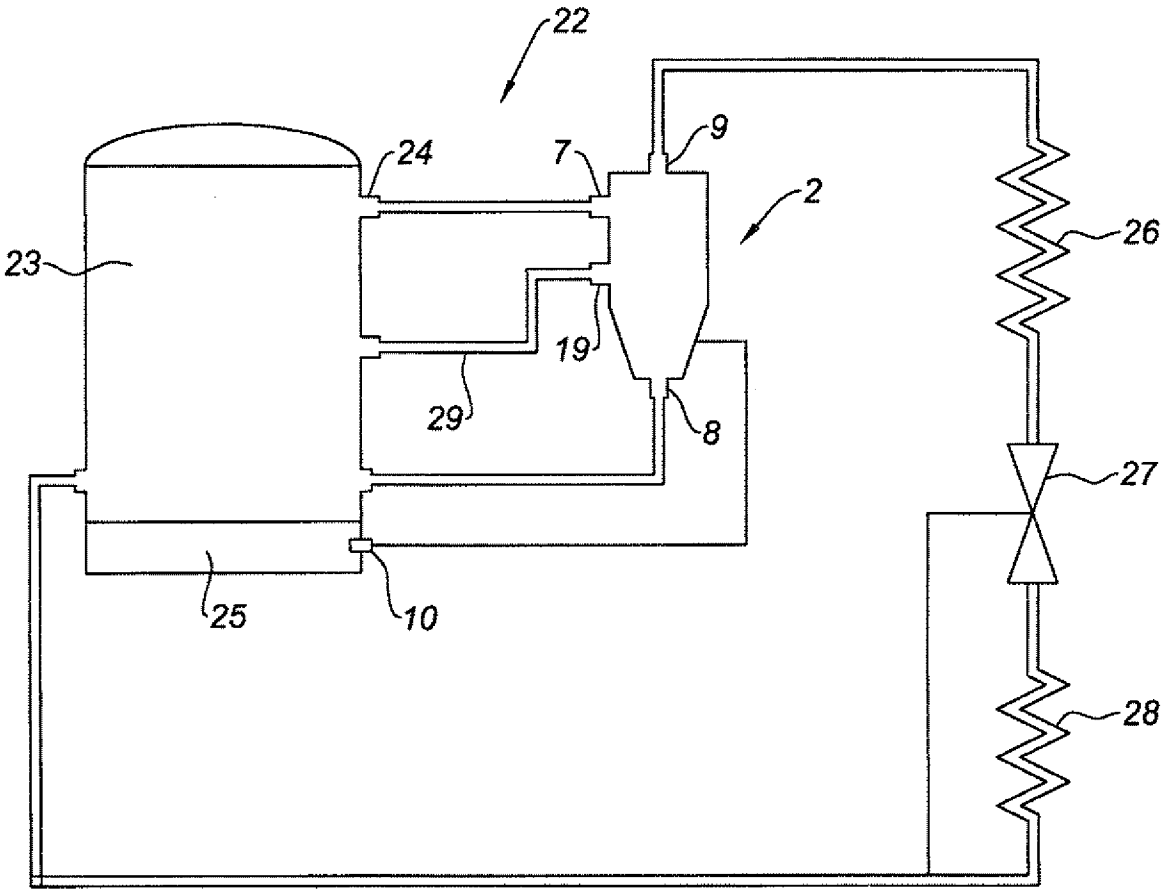
FIG. 4 is a diagrammatic view of a heating and/or refrigerating system including the separating device of FIG. 1.

FIG. 4 shows a heating and/or refrigeration installation 22 including the separating device 2, and a refrigerant compressor 23 comprising, on the one hand, a discharge orifice 24 for a lubricant-refrigerating gas mixture connected to the inlet orifice 7 of the separating device, and on the other hand a lubricant pan 25 connected to the lubricant outlet orifice 8.

The heating and/or refrigeration installation 22 also has a condenser 26 connected to the upper refrigerating gas discharge orifice 9, a reducing valve 27 and an evaporator 28.

The operation of such an installation will now be described.

When the installation on which the separating device 2 is arranged is turned on, the refrigerant compressor 23 of this installation compresses an oil-refrigerating gas mixture and discharges said mixture at its discharge orifice 24. This oil-refrigerating gas mixture then penetrates the separating chamber 4 of the separating device via the inlet orifice 7.

Then, due to the configuration of the separating chamber 4, the oil-refrigerating gas mixture begins to rotate along the inner wall of the separating chamber 4, which causes the centrifugation of the oil-refrigerating gas mixture. This results in the coalescence of the drops of oil on the inner wall of the separating chamber 4, then the drop by gravity of the oil towards the lower end of the second tapered portion 6, i.e. towards the lower oil outlet orifice 8, and the flow of refrigerating gas through the upper orifice 9 towards the condenser 26.

Then, the temperature sensor 10 measures the temperature of the oil contained in the lubricant pan 25 of the compressor 23 and the regulating means 12 comparing this value to a second predetermined value.

If the temperature of the oil contained in the lubricant pan 25 is less than or identical to said second predetermined value, the control means does not control the power supply of the fan 13 and the oil separated in the separating chamber 4 is directly turned back towards the oil pan 25 of the compressor 23 via the lower orifice 8 of the oil outlet without being cooled by the fan.

On the contrary, if the temperature of the oil contained in the lubricant pan 25 is higher than said second predetermined value, the control means controls the operation of the fan 13 so that the latter cools the oil separated in the separating chamber 4. It should be noted that the control means is arranged to adjust the rotational speed of the fan 13 as a function of the temperature measured by the temperature sensor 11 so that the fan cools the oil separated in the separating chamber 4 so that it has a temperature substantially corresponding to the first predetermined value.

Once the temperature of the oil contained in the lubricant pan 25 once again becomes lower than or identical to the second predetermined value, the control means 12 controls the stop of the fan 13.

Advantageously, the first predetermined value is greater than the saturation temperature of the refrigerating gas. Thus, the separating device according to the invention makes it possible to prevent the injection of oil at too low a temperature into the pan of the compressor, and therefore the injection of oil rich in refrigerating gas.

It should be noted that according to FIG. 4, the poppet valve 19 of the separating device 2 is connected to the low-pressure part of the compressor 23 via a circulation pipe 29. Thus, when the pressure reigning in the separating chamber 4 exceeds a predetermined value, the refrigerating gas is reoriented towards the compressor and not towards the atmosphere. Such an assembly of the valve is preferred when the refrigerating gas is for example a hydrofluorocarbon or a hydrochlorofluorocarbon.

According to one embodiment of the invention, the predetermined value at which the regulating means 12 regulates the temperature of the separated oil is not fixed, but varies as a function of the suction and/or discharge pressure of the compressor. According to this embodiment, the separating device comprises a pressure sensor arranged to measure the suction and/or discharge pressure of the refrigerant compressor to which the separating device is connected. According to one embodiment of the invention, the separating device is connected to a pressure sensor arranged to measure the suction and/or discharge pressure of the refrigerant compressor to which the separating device is connected.

According to one embodiment not shown in the figures, the temperature sensor 11 could be arranged at the second end 18 of the heat exchanger 16.

According to another embodiment of the invention, the regulating means 12 could be arranged to regulate the temperature of the separated lubricant in a range of predetermined values as a function of the temperatures measured by the temperature sensors 10, 11. According to this embodiment, when the temperature of the oil contained in the lubricant pan 25 is greater than the second predetermined value, the control means controls the power supply of the fan 13 and regulates the rotational speed of the latter as a function of the temperature measured by the temperature sensor 11 so that the fan cools the oil separated in the separating chamber 4 so that it has a temperature in the predetermined range of values.

Figure 3:
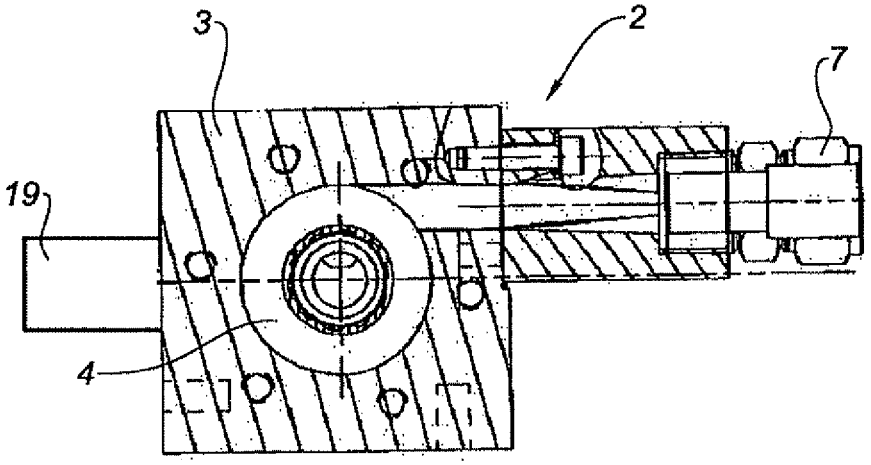
FIG. 3 is a cross-sectional view along line II-II of FIG. 2.
Figure 2:
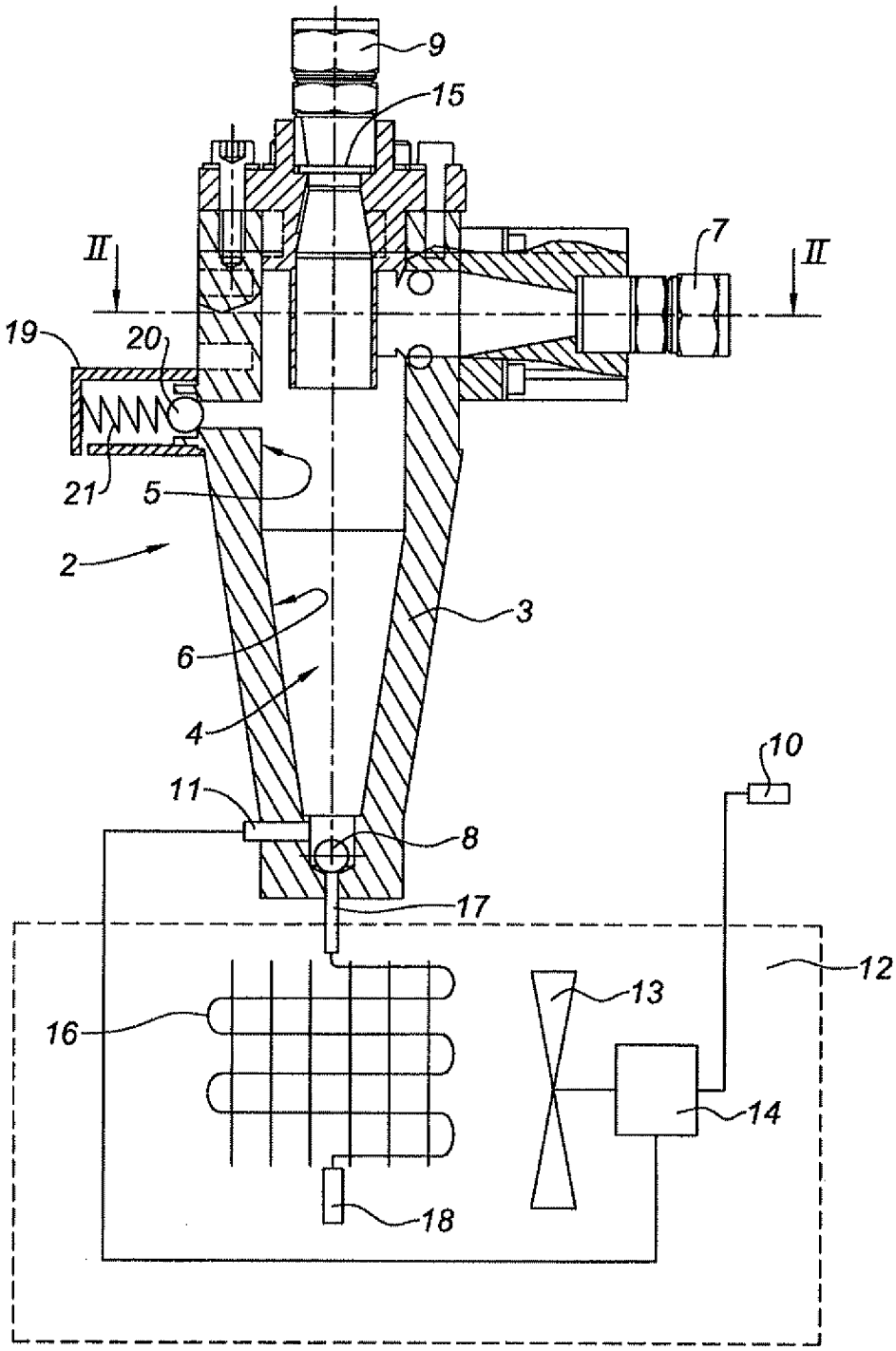
FIG. 2 is a longitudinal cross-sectional view of the separating device of FIG. 1.
Figure 5:
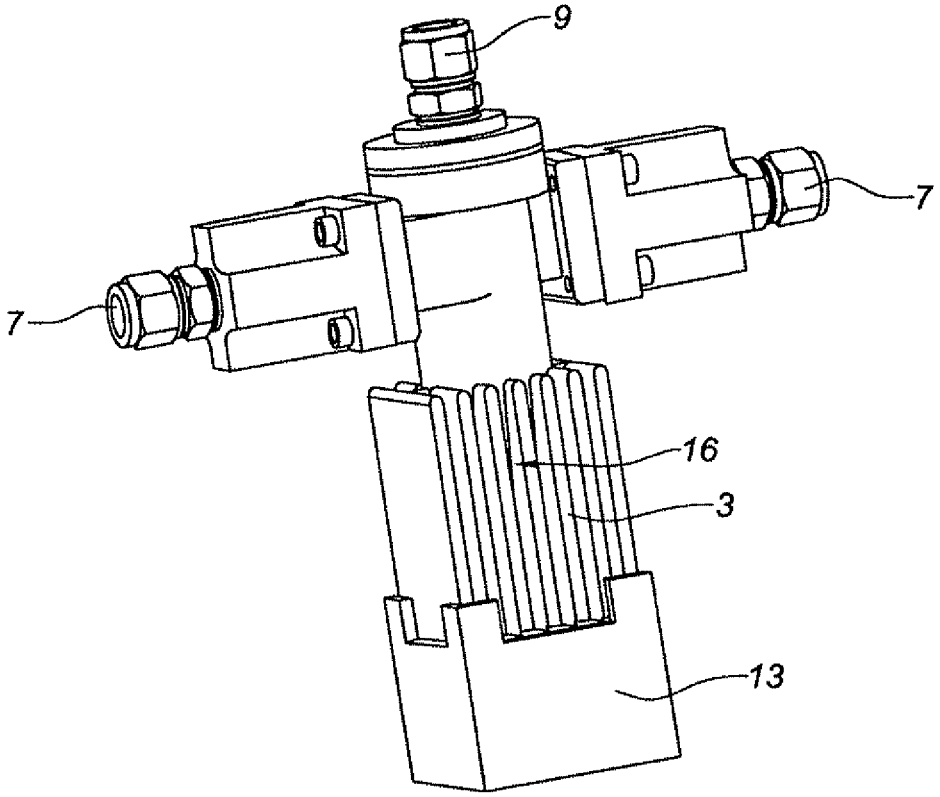
FIG. 5 is a perspective view of a separating device according to a second embodiment of the invention.
Figure 6:
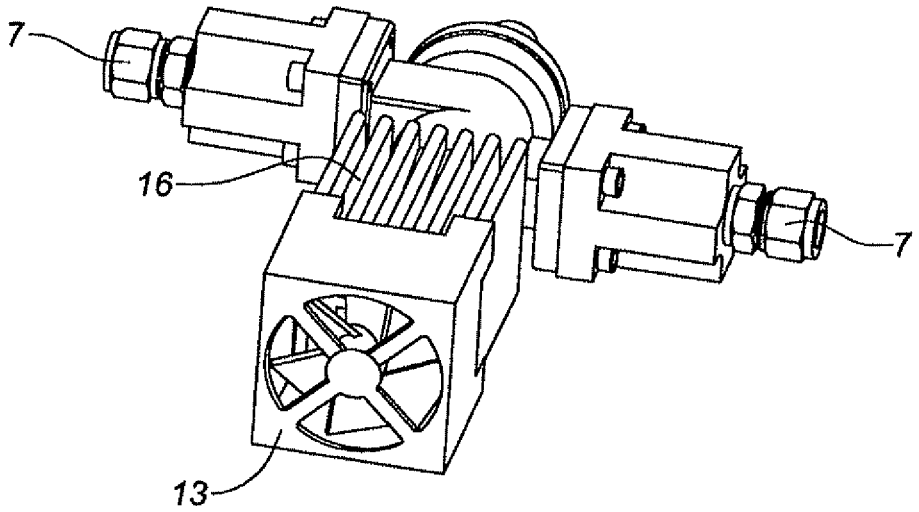
FIG. 6 is a perspective bottom view of the separating device of FIG. 5.
Figure 7:
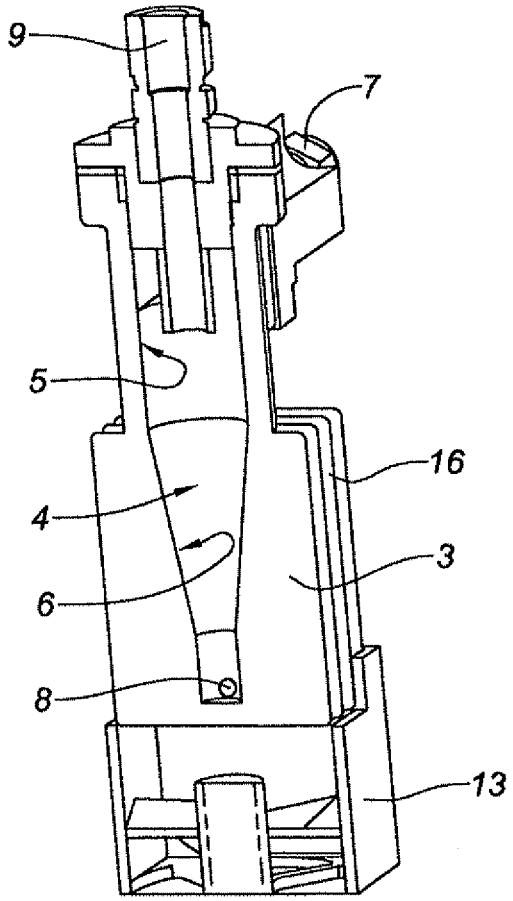
FIG. 7 is a longitudinal cross-sectional view of the separating device of FIG. 5.

FIGS. 5 to 7 show a separating device according to a second embodiment that differs from that shown in FIGS. 1 to 3 essentially in that it has two inlet orifices 7 emerging tangentially in the separating chamber 4. Each inlet orifice 7 is intended to be connected to the discharge orifice of a refrigerant compressor or a compression unit of a same refrigerant compressor.

According to this embodiment, the regulating means has a gilled radiator 16 as heat exchanger.

According to one alternative embodiment not shown in the figures, the regulating means could also include a heating device, and the control means could be arranged to control the operation of the heating device as a function of the temperatures measured by the temperature sensors. Preferably, the heating device is a resistance.

According to another embodiment of the invention not shown in the figures, the separating device comprises a verification means arranged to verify the stopping of the compressor if the lubricant temperature measured by the temperature sensor 10 is above a predetermined value.

Of course the invention is not limited solely to the embodiments of this separating device described above as examples, but rather encompasses all alternative embodiments.

The invention claimed is:

1. A device for separating lubricant from a lubricant-refrigerating gas mixture discharged from at least one refrigerant compressor, the separating device comprising:

a body delimiting a separating chamber;

at least one inlet orifice emerging in the separating chamber and intended to be connected to a discharge orifice of the refrigerant compressor so as to allow the lubricant-refrigerating gas mixture to be introduced into the separating chamber;

at least one lubricant outlet orifice emerging in the separating chamber and intended to be connected to a lubricant pan formed in the refrigerant compressor;

a first measuring element configured to measure the temperature of the lubricant contained in the lubricant pan formed in the refrigerant compressor;

a second measuring element configured to measure the temperature of the separated lubricant in the separating chamber; and a regulating element configured to regulate the temperature of the separated lubricant in the separating chamber to at least a first predetermined value or into a predetermined range of values as a function of the temperatures measured by said first and second measuring elements, wherein the regulating element;

(i) is directly attached to the separating chamber, (ii) comprises a fan and a control element configured to control an operation and a rotational speed of the fan as a function of the temperatures measured by the first and second measuring elements, and (iii) is configured such that, when the temperature measured by the first measuring element is greater than a second predetermined value, the control element controls a power supply of the fan to regulate a rotational speed of the fan such that the fan cools the temperature of the separated lubricant in the separating chamber to at least the first predetermined value or into a predetermined range of values.

2. The separating device according to claim 1, further comprising a refrigerating gas discharge orifice emerging in the separating chamber, and a check device able to move between a position covering the discharge orifice and a position freeing the discharge orifice.

3. The separating device according to claim 1, further comprising a poppet valve, mounted on the body, the poppet value being able to move between an open position in which the separating chamber is put in communication with the atmosphere and a closed position, the poppet valve being moved into its open position when the pressure reigning in the separating chamber exceeds a predetermined value.

4. The separating device according to claim 1, further comprising several inlet orifices emerging in the separating chamber, the inlet orifices each being intended to be connected to the discharge orifice of a different refrigerant compressor or a different compression unit of the same refrigerant compressor.

5. The separating device according to claim 1, wherein the regulating element is configured to regulate the temperature of the separated lubricant at the first predetermined value and the second predetermined value, the first predetermined value is greater than the second predetermined value, and the regulating element further comprises a selection element configured to select, among the first and second predetermined values, the value at which the temperature of the separated lubricant must be regulated.

6. The separating device according to claim 1, wherein the regulating element comprises at least one cooling device configured to cool the separated lubricant and/or at least one heating device configured to heat the separated lubricant.

7. The separating device according to claim 6, wherein the regulating element comprises a control element configured to control the operation of the cooling device and/or the heating device as a function of the temperature of the lubricant measured by the first and/or second measuring elements.

8. The separating device according to claim 1, wherein the first and/or second measuring elements are temperature sensors.

9. The separating device according to claim 1, wherein the separating device is a cyclone separating device.

10. A heating and/or refrigeration system including at least one refrigerant compressor comprising a discharge orifice of a lubricant-refrigerating gas mixture, comprising the separating device according to claim 1, wherein the inlet orifice of the separating device is connected to the discharge orifice of the refrigerant compressor.

11. The heating and/or refrigeration system according to claim 10, comprising several refrigerant compressors, the discharge orifice of each refrigerant compressor being connected to the inlet orifice of the separating device.

12. A device for separating lubricant from a lubricant-refrigerating gas mixture discharged from at least one refrigerant compressor, the separating device comprising:

a body delimiting a separating chamber;

at least one inlet orifice emerging in the separating chamber and intended to be connected to a discharge orifice of the refrigerant compressor so as to allow the lubricant-refrigerating gas mixture to be introduced into the separating chamber;

at least one lubricant outlet orifice emerging in the separating chamber and configured to be connected to a lubricant pan formed in the refrigerant compressor;

a first temperature sensor configured to measure the temperature of the lubricant contained in the lubricant pan formed in the refrigerant compressor;

a second temperature configured to measure the temperature of the separated lubricant in the separating chamber; and a regulating element configured to regulate the temperature of the separated lubricant in the separating chamber to at least a first predetermined value or into a predetermined range of values as a function of the temperatures measured by said first and second temperature sensors, wherein the regulating element:

(i) is directly attached to the separating chamber, (ii) comprises a fan and a control element configured to control an operation and a rotational speed of the fan as a function of the temperatures measured by the first and second measuring elements, and (iii) is configured such that, when the temperature measured by the first measuring element is greater than a second predetermined value, the control element controls a power supply of the fan to regulate a rotational speed of the fan such that the fan cools the temperature of the separated lubricant in the separating chamber to at least one predetermined value or into a predetermined range of values.

13. The separating device according to claim 1, wherein the regulating element:

compares the temperature measured by the first measuring element with the second predetermined value, and if the temperature measured by the first measuring element is less than or identical to the second predetermined value, the regulating element stops control of the fan.

14. The separating device according to claim 1, wherein when the temperature measured by the first measuring element is greater than the second predetermined value, the regulating element controls the power supply of the fan to regulate the rotational speed of the fan such that the fan cools the temperature of the separated lubricant in the separating chamber into the predetermined range of values.

15. The separating device according to claim 1, wherein the first predetermined value is greater than a saturation temperature of the refrigerating gas, and when the temperature measured by the first measuring element is greater than the first predetermined value, the control element controls the power supply of the fan to regulate the rotational speed of the fan such that the fan cools the temperature of the separated lubricant in the separating chamber into the predetermined range of values.

* * * * *